US005902258A

United States Patent [19]

Cziriak

[11] Patent Number: 5,902,258

[45] Date of Patent: May 11, 1999

[54] MASSAGE DEVICE

[76] Inventor: Attila Cziriak, Apt. 908, 25 Warrender Avenue, Etobicoke, Ontario, Canada, M9B 5Z4

[21] Appl. No.: 08/573,098

[22] Filed: Dec. 15, 1995

[51] Int. Cl.[6] ..... A61H 1/00

[52] U.S. Cl. ..... 601/55; 601/95; 601/96; 601/112; 601/116; 601/134

[58] Field of Search ..... 601/55, 88, 96, 601/73, 77, 167, 169, 111, 112, 134, 131, 97, 101, 108, 105, 113

[56] References Cited

U.S. PATENT DOCUMENTS

| | | | |
|---|---|---|---|
| 1,305,348 | 6/1919 | Mapgood | 601/88 |
| 2,067,991 | 1/1937 | Taylor | 601/112 |
| 3,625,204 | 12/1971 | Sekiguchi . | |
| 3,716,048 | 2/1973 | Alonso | 601/95 |
| 3,968,789 | 7/1976 | Simoncini . | |
| 4,498,463 | 2/1985 | Roming . | |
| 4,603,688 | 8/1986 | Roming . | |
| 4,633,858 | 1/1987 | Rutsch et al. . | |
| 4,733,655 | 3/1988 | Smal . | |
| 5,090,402 | 2/1992 | Bazin et al. . | |
| 5,103,809 | 4/1992 | DeLuca et al. . | |
| 5,129,121 | 7/1992 | Gelman | 15/29 |
| 5,167,225 | 12/1992 | Cheng-I | 601/112 |
| 5,183,034 | 2/1993 | Yamasaki et al. . | |
| 5,385,532 | 1/1995 | Shyu | 601/160 |
| 5,447,491 | 9/1995 | Bellandi | 601/108 |

FOREIGN PATENT DOCUMENTS

| | | | |
|---|---|---|---|
| 1067776 | 12/1979 | Canada . | |
| 4-114330 | 10/1992 | Japan | 601/108 |
| 1635990 | 3/1991 | U.S.S.R. | 601/111 |
| 2 227 942 | 8/1990 | United Kingdom . | |

*Primary Examiner*—Richard J. Apley
*Assistant Examiner*—Justine R. Yu
*Attorney, Agent, or Firm*—Peter R. Hammond

[57] ABSTRACT

A massaging device driven by a water wheel and having a plurality of fingers spread in concentric rings about an arched cover. The fingers are supported in and actuated by a rotating camming platform including a series of concentric camming surfaces with curved bases and irregularly shaped annular sidewalls. The fingers are reciprocated along their vertical axes to create a wave-like motion relative to the cover. Concurrently, the fingers are actuated to pivot about a central transverse axis defined by pin members located on opposite sides of the fingers. When driven by a water wheel, the device contains a water channel along its base, which channel extends to a water chamber containing the water wheel. The wheel is turned by water flow through the chamber thereby rotating the camming platform to which it is coupled by way of gears.

19 Claims, 5 Drawing Sheets

MASSAGE DEVICE

BACKGROUND OF THE INVENTION

The present invention relates to massaging devices, in particular, to massaging devices suitable as foot massagers.

The present massaging device is useful therapeutically given that when the user's feet are placed on its cover, the rhythmical movement of the fingers mounted therein creates, in addition to a pleasant sensation in and on the foot inducing relaxation and increased blood flow through the feet, a simulation of accupressure massage stimulating reflex zones and points and improving body health.

The use of handheld massaging devices is known. There are a variety of battery operated massagers on the market which provide massaging action in different ways.

A water pressure driven massage apparatus with a plurality of massage members spread about its surface is disclosed by U.S. Pat. No. 4,603,688 issued Aug. 5, 1986 to Roming. This device operates so that the body part being massaged pushes the massaging members back against projections on the water turbine which is driven by water pressure. At the same time, water exits through the cover on the front of the device. This device is not geared in any way.

U.K. published patent application 2,227,942 by Katsunuma et al discloses a handheld massager capable of accommodating various different attachments. The device does have a rotatable cam which actuates the massaging members. However, the device is not geared and does not have a driving mechanism capable of being driven by water flow.

SUMMARY OF THE INVENTION

The present invention is a massager capable of being driven by a water wheel or turbine. It is especially effective as a foot massager. The device has a plurality of massaging fingers supported in holes on the cover. The fingers move rhythmically relative to the surface of the device to provide a massaging action. The preferred device is arched in shape so that it can comfortably mold to the human foot or hand to which it provides massaging action.

According to one aspect of the invention, the massaging device suitable for massaging feet has a housing with a plurality of holes distributed about its surface. These holes extend through a top cover. The housing also has an elongate substantially enclosed water channel and a water chamber formed therein. The water channel extends to an opening into the water chamber. The massaging device has a wheel which is rotatably mounted in the water chamber. This wheel is adapted to be rotated by water flowing through the channel and into and out of the chamber.

Also included in this aspect of the invention are a plurality of massaging fingers mounted in the holes about the housing surface. Each finger has a central longitudinal axis along which the finger is capable of moving to a limited extent.

A rotatable finger platform is located in the housing and supports the plurality of fingers at the inner ends of the fingers. This platform has a top surface provided with at least one camming surface for engaging the ends of the fingers.

The massaging device has a gear drive system operatably connecting the water wheel to the finger platform. Rotation of the water wheel causes the finger platform to rotate. Rotation of the finger platform causes at least one camming surface to push the fingers outwardly in a periodic manner in order to produce massaging action by the fingers.

According to another aspect of the invention, the massaging device has a housing with a cover and a plurality of holes distributed about its surface. The holes extend through the cover. Vertically extending guide slots are provided at each hole. Mounted in the holes are a plurality of massaging fingers. Each finger has a central longitudinal axis along which the finger is capable of moving to a limited extent. Each finger has two pivot pins projecting from opposite sides thereof and axially aligned with each other. These pins are movable up and down in their respective slots and are guided thereby. The massaging device has a rotatable finger platform located in the housing which supports the plurality of fingers at their inner ends. The platform provides two or more generally annular camming surfaces for engaging the inner ends of the fingers.

This massaging device has a power drive system for rotating the finger platform. Rotation of the finger platform causes the camming surfaces to push the fingers outwardly in a periodic manner in order to produce a massaging action by the fingers.

According to another aspect of the invention, the massaging device has a housing having a cover with a number of holes in its surface that extend through the cover. Mounted in the holes are a number of massaging fingers. Each finger has a central longitudinal axis along which the finger is capable of moving to a limited extent. This embodiment has pin members which extend outwardly from the fingers in a transverse direction. These pin members define a transverse pivot axis for each finger. Vertical guide slots are provided along the sides of the holes. The pin members are movable up and down in their respective guide slots.

Within the housing there is a movable support member supporting the fingers at their inner ends. The support member has an upper surface which is provided with at least one cam track for engaging the inner ends of the fingers extending along the upper surface of the support member. Each track has a bottom and two sidewalls disposed on opposite sides of the bottom. The bottom of each track slopes or bends upwardly and downwardly at intervals along the length of the track. The sidewalls at each track extend generally parallel to each other but slope or bend left or right at intervals relative to the direction of movement of the support member.

The device has a power drive system for moving the support member relative to the housing. The movement of the support member causes the cam track both to push the fingers upwardly in a periodic action and to pivot the fingers about their respective transverse pivot axes in order to produce a massaging action by the fingers.

BRIEF DESCRIPTION OF THE DRAWINGS

In drawings which illustrate embodiments of the invention.

DETAILED DESCRIPTION OF PREFERRED EMBODIMENT

Figure 1:
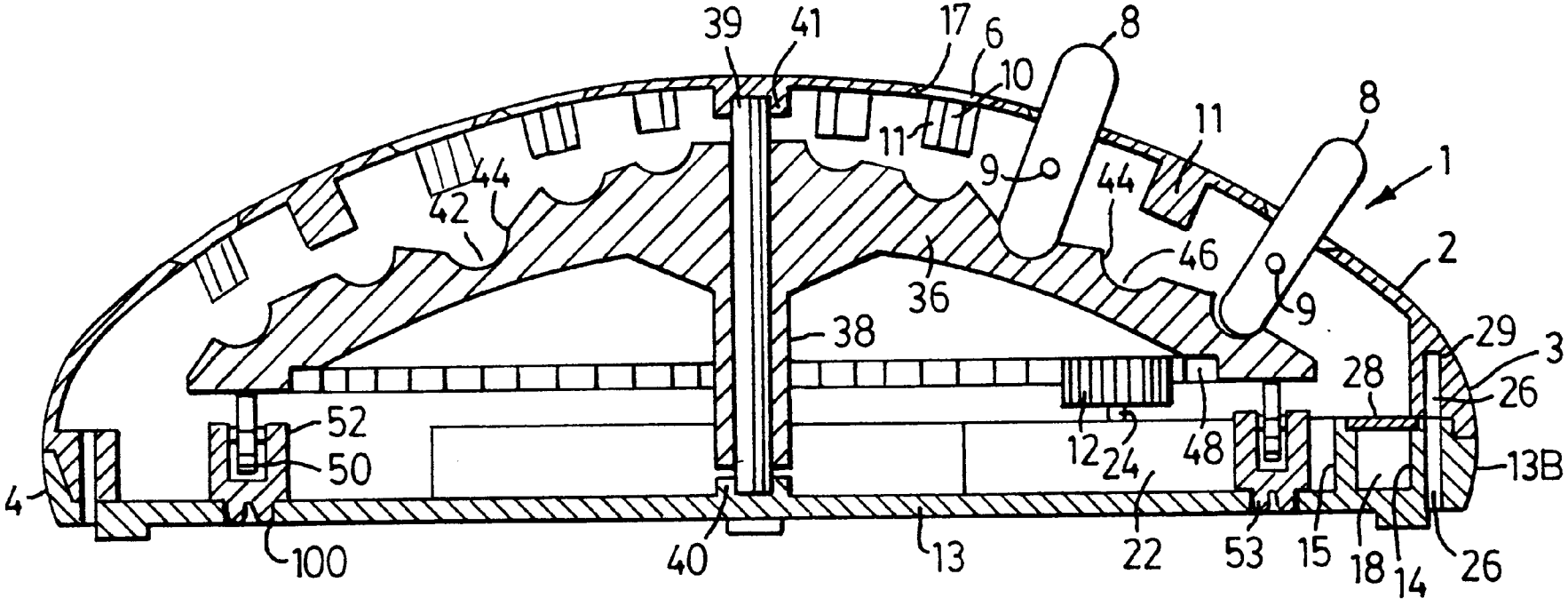
FIG. 1 is a vertical axial cross-section of the massage device taken along line I—I of FIG. 2.
Figure 3:
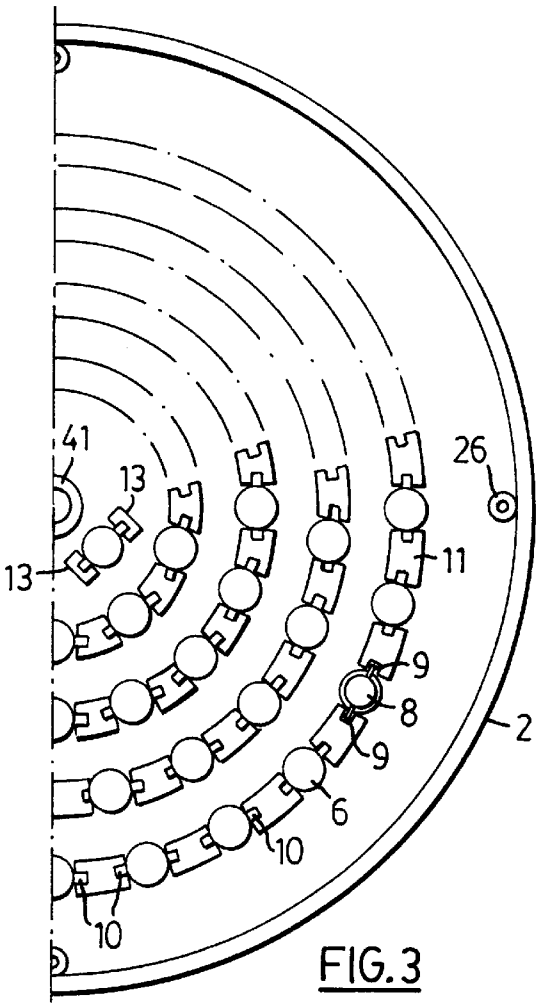
FIG. 3 is a bottom view showing one half, the other half being essentially the same.

A preferred form of massaging device 1 constructed in accordance with the invention is shown in sectional elevation in FIG. 1. This massaging device has a housing 3 that includes a cover 2 with a plurality of holes 6 distributed about its surface and extending through the cover. A plurality of massaging fingers 8 are mounted in these holes. Each finger has a central longitudinal axis along which the finger is capable of moving to a limited extent. If desired, the fingers 8 can be hollow plastic members, thereby reducing the weight of the overall device. Although only a couple of fingers are shown in FIG. 1 and one finger is shown in FIG. 3 to provide a bottom view, it will be appreciated that each of the holes 6 is provided with its own finger and these fingers are essentially or substantially the same in their construction.

Figure 4:
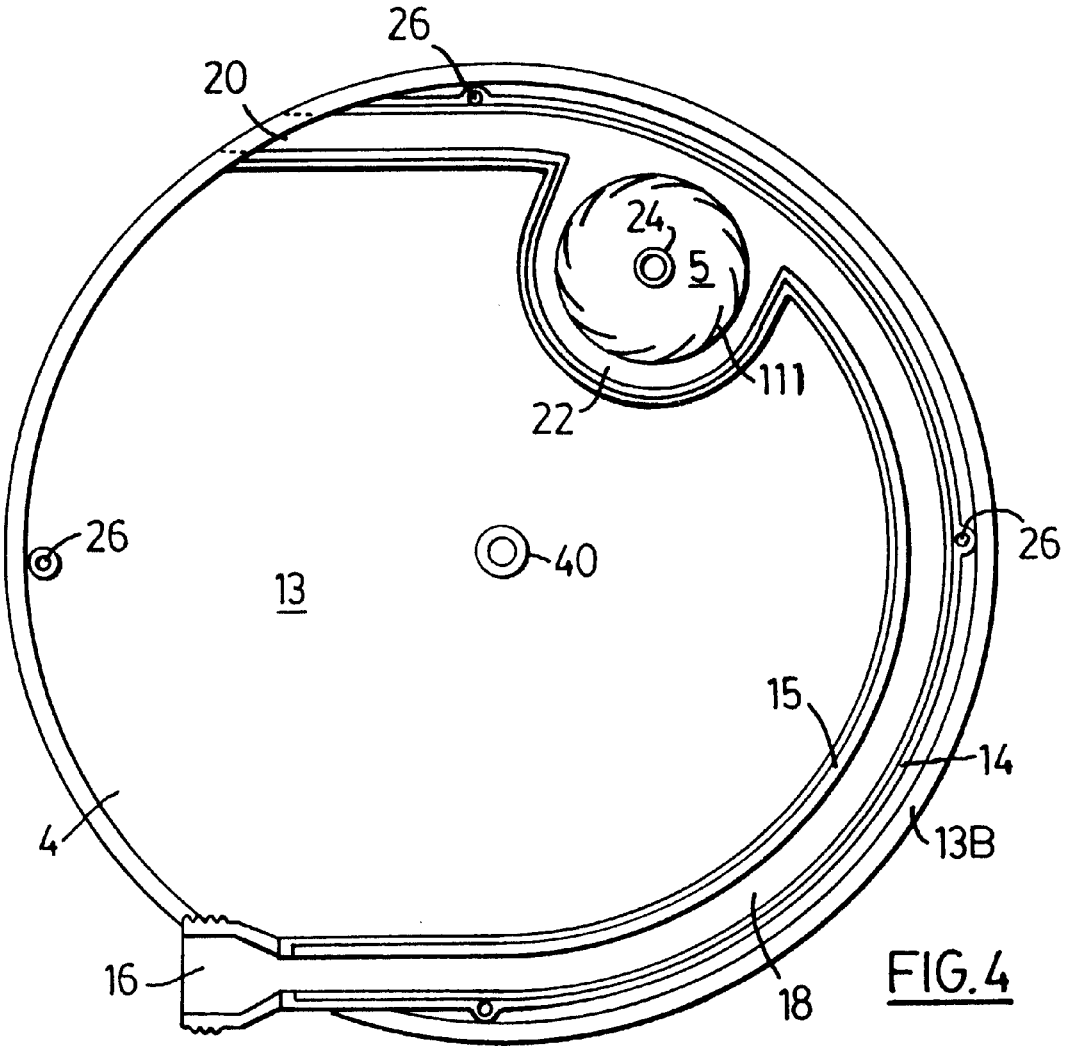
FIG. 4 is a top view of the base.
Figure 5:
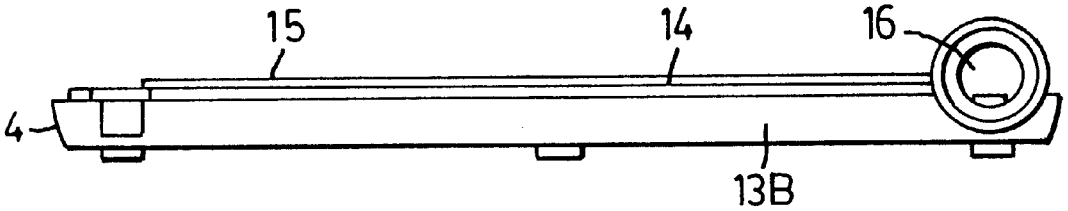
FIG. 5 is a side view of the base.

Other major components of the massaging device 1 include a rotatable finger platform 36 located in the housing and supporting the plurality of finger 8 at their inner ends. This platform 36 is provided with at least one camming surface as explained hereinafter for engaging the inner ends of the fingers. The illustrated preferred embodiment of the finger platform has in fact five camming surfaces which are formed in the top of the platform and these are generally annular in shape. The housing also includes a base or bottom section 4 which forms a circular bottom 13 and which is generally planar. This base 4 forms a lower section of an elongate water channel 18 and a water chamber 22. As shown in FIG. 4, the channel 18 extends to and opens into the substantially enclosed water chamber 22. A water wheel 5 is rotatably mounted in the water chamber and is adapted to be rotated by water flowing through the and out of channel and into the chamber. This water wheel has paddles or fins 111 which cause the wheel to turn as a result of the flow of water through the channel and past the water wheel. The water wheel turns about its own central shaft 24 which can be integrally formed with the water wheel or a separate component. If the shaft is separate, it can be a metal shaft for added strength and rigidity. The wheel itself is preferably made from a suitable strong plastics material. A pinion gear 12 is attached to the water wheel and is turned thereby. The gear 12 is connected to the water wheel by means of the shaft 24 which extends through a sealed opening in the top of the chamber 22. It will be appreciated that rotation of the finger platform 36 by the water wheel causes the one or more camming surfaces thereon to push the fingers 8 outwardly in a periodic manner in order to produce a massaging action by the fingers. The base 4 can be detachably connected to the cover 2 by means of flat headed metal screws (not shown). These screws can extend upwardly through a number of vertical passageways 26.

Figure 2:
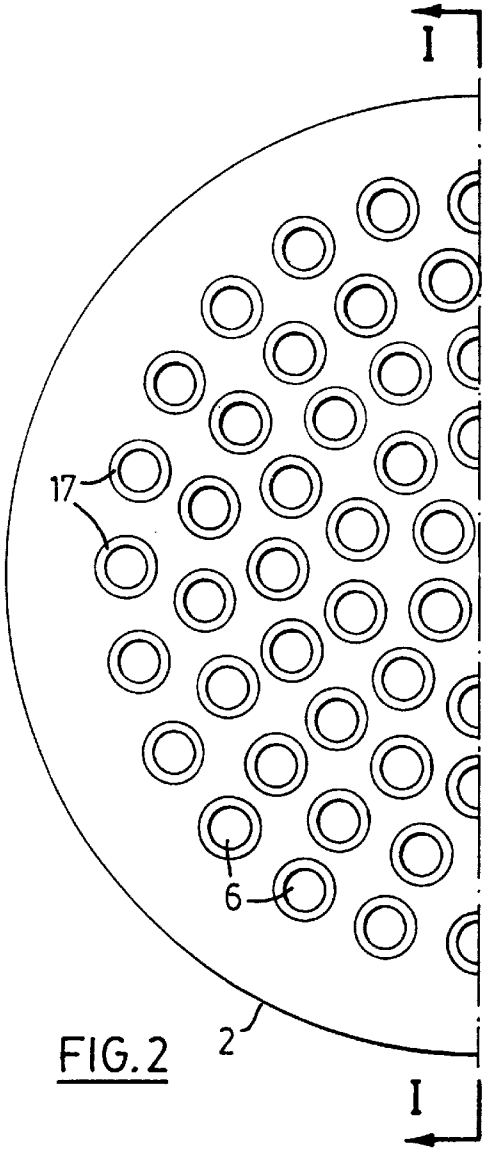
FIG. 2 is a top view showing one half of the device, the other half being essentially the same.

Turning now to a more detailed discussion of the major components of the device 1, it will be noted that each finger 8 is provided with two pivot pins or pin members 9 projecting from opposite sides of the respective finger and axially aligned with each other. These pivot pins form a transverse pivot axis for each finger. Generally vertical guide slots 10 are formed in the cover 2 adjacent each hole 6. These guide slots are formed by guide members 11 that extend downwardly from the cover and which are generally H-shaped in a bottom view (see FIG. 3). Thus, each guide member 11 forms two of the guide slots 10. However, at the top of the cover, there can be smaller guide members 13 which are channel shaped and which form only a single guide slot. Preferably the guide members 11 are provided with means for retaining the fingers 8 in their respective holes. For example, a stop member 15 (see FIG. 1) can be provided at the upper end of each guide slot 10. The stop member may comprise a plastic web extending across the upper end of the slot. Another preferred feature of the cover 2 shown in FIGS. 1 and 2 is that each hole 6 is formed with a sloping side wall 17, which construction enables each finger to pivot about the transverse axis formed by the pivot pins 9 as explained further hereinafter.

With respect to the construction of the fingers 8, in one preferred embodiment the length of each finger is about 2 cm or approximately ¾ inch and the width of each finger is about 7 mm. The fingers 8 are preferably formed with rounded ends and in the illustrated embodiment each end forms a hemisphere. A rounded top for the finger is, of course, desirable, so that a comfortable massaging effect will be induced by the fingers and the fingers will not tend to scrap or scratch the skin surface. A hemispherical bottom end of each finger is desirable so that the end will fit closely in its respective cam track formed on top of the platform 36. As can be seen in FIG. 1, each cam track preferably has a shape in transverse cross-section which is generally semi-circular. As explained further hereinafter, the rounded bottom end of each finger and the rounded cross-section of the cam track enables each finger to pivot to a limited extent about its transverse axis formed by the pivot pins 9. Preferably the radius of the bottom end of each finger is slightly smaller than the radius of the cam track in which the bottom end is received. This enables and enhances the ability of the cam track to pivot its respective fingers as the platform 36 rotates.

Figure 6:
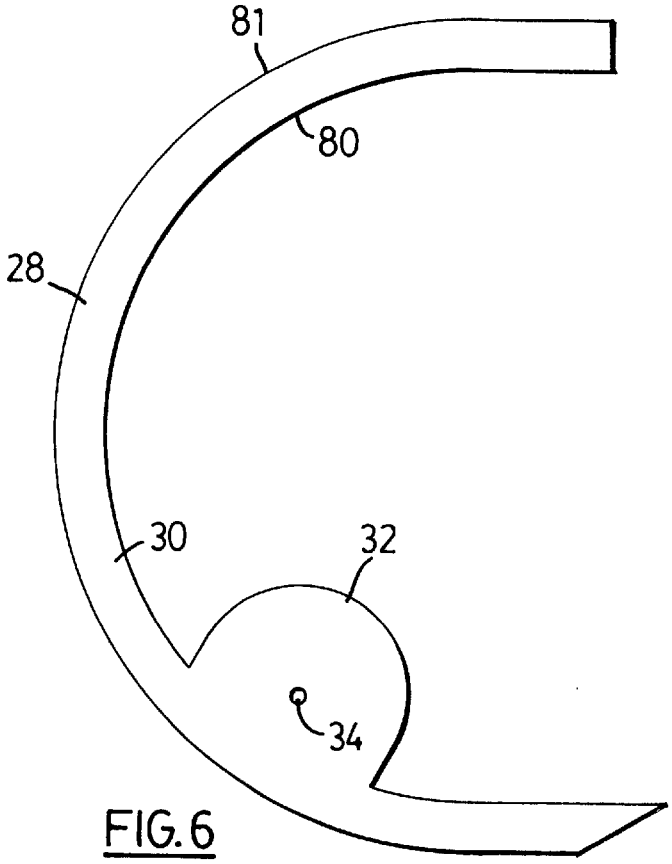
FIG. 6 is a plan view of the water channel cover.

The construction of the base 4 will now be further described with particular reference to FIGS. 1 and 4 to 6. The base 4 has an outer wall 13B which, except for the outlet and inlet of the channel 18, extends about the entire circumference of the base. It is this outer wall that supports the bottom edge of the cover 2. Extending generally parallel to the outer wall 136 are two walls 14 and 15 which form the side walls of the water channel 18. These two interior walls are generally in the shape of concentric semi-circles and the wall 14 is quite close to the outer wall 13B. Both of the walls 14 and 15 can be recessed along their top edges (as shown in FIG. 1) to accommodate and support a channel cap 28. The cap 28 is a flat cover piece, the shape of which is shown in FIG. 6. This cover piece is attached to the walls 14 and 15 in such a manner that it seals the water channel and the chamber 22. A suitable adhesive can be used for this purpose. The cap includes an elongate, generally semi-circular channel portion 30 and a chamber portion 32 shaped to fit the top of the chamber 22. At the centre of the portion 32 is a shaft hole 34 through which the wheel shaft 24 extends. When the cap is fitted in place, its curved inner edge 80 forms a seal with the inner wall 15 and the outer edge 81 forms a seal with the wall 14 of the base.

The water channel 18 has means for connecting a source of water to an inlet end of the channel. In particular and as illustrated in FIG. 4, there is a threaded water inlet 16 at one end of the channel 18, which inlet is adapted for connection to a pressurized water supply. There is also a water outlet 20 at the opposite end of the channel. A relatively short section of the channel extends from the water chamber 22 to the outlet 20. If desired, the outlet 20 could also be provided with a hose fitting to enable the outlet to be connected to a flexible hose or to a pipe. In this way, the escaping water could be directed to a sink or drain.

The finger platform 36 is generally complimentary in shape to the cover 2. In the illustrated device, both the cover 2 and the finger platform are generally dome shaped, a shape considered to be particularly desirable for massaging certain areas of the body such as the bottom of one's feet. However, it will be appreciated that the cover and the underlying platform can have other shapes that will also work satisfactorily. For example, the cover can have a generally flat top in which the holes 6 are provided, in which case the platform would also be generally flat on top except for the cam tracks formed therein. As illustrated, preferably the cover and the finger platform are coaxial along a central vertical axis, this axis extending through a central shaft 39. In the case where the cover and finger platform are dome shaped, it will be noted that the annular camming surfaces or the cam tracks are arranged at different heights relative to the aforementioned vertical axis.

Figure 9:
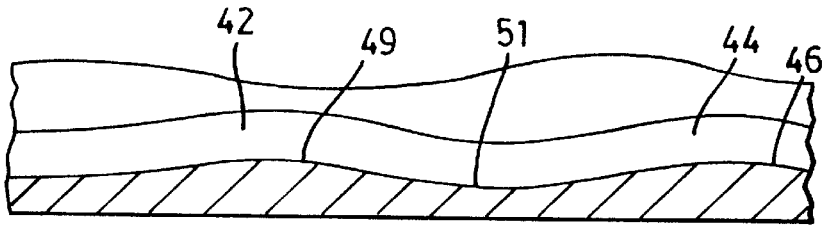
FIG. 9 is a schematic elevation taken along the longitudinal centerline of one of the cam tracks in the finger platform.

The illustrated platform 36 has five channels or tracks 42, each of which has a bottom or base 46 which support the fingers 8 that travel along the respective track. It will be appreciated that the number of tracks 42 could be more or less than 5 with the number depending to some extent on the size of the massaging device desired and the intended purpose of the massaging device. Each cam track has two side walls 44 disposed on opposite sides of the bottom 46. The bottom 46 of each track slopes or bends upwardly or downwardly at intervals along the length of the track as illustrated in FIG. 9 which shows a portion of the track 46, this view being taken along the centerline of the track. As shown in FIG. 9, the base of the track has periodic high points 49 as well as periodic low points 51 and these high and low points can be staggered with respect to the high and low points of the adjacent cam track, if desired. In the illustrated preferred embodiment, the camming surfaces formed by the bottom of the channels or tracks are generally sinusoidal in shape when viewed along the vertical cross-section taken along the longitudinal centerline of each channel. It is the movement of the sinusoidal camming surface which causes the fingers 8 to more upwardly and downwardly as the finger platform rotates. It will be appreciated that the fingers 8 are caused to more downwardly when permitted by the platform due to the influence of gravity and also pressure applied by the body part to the upper ends of the respective fingers.

Figure 8:
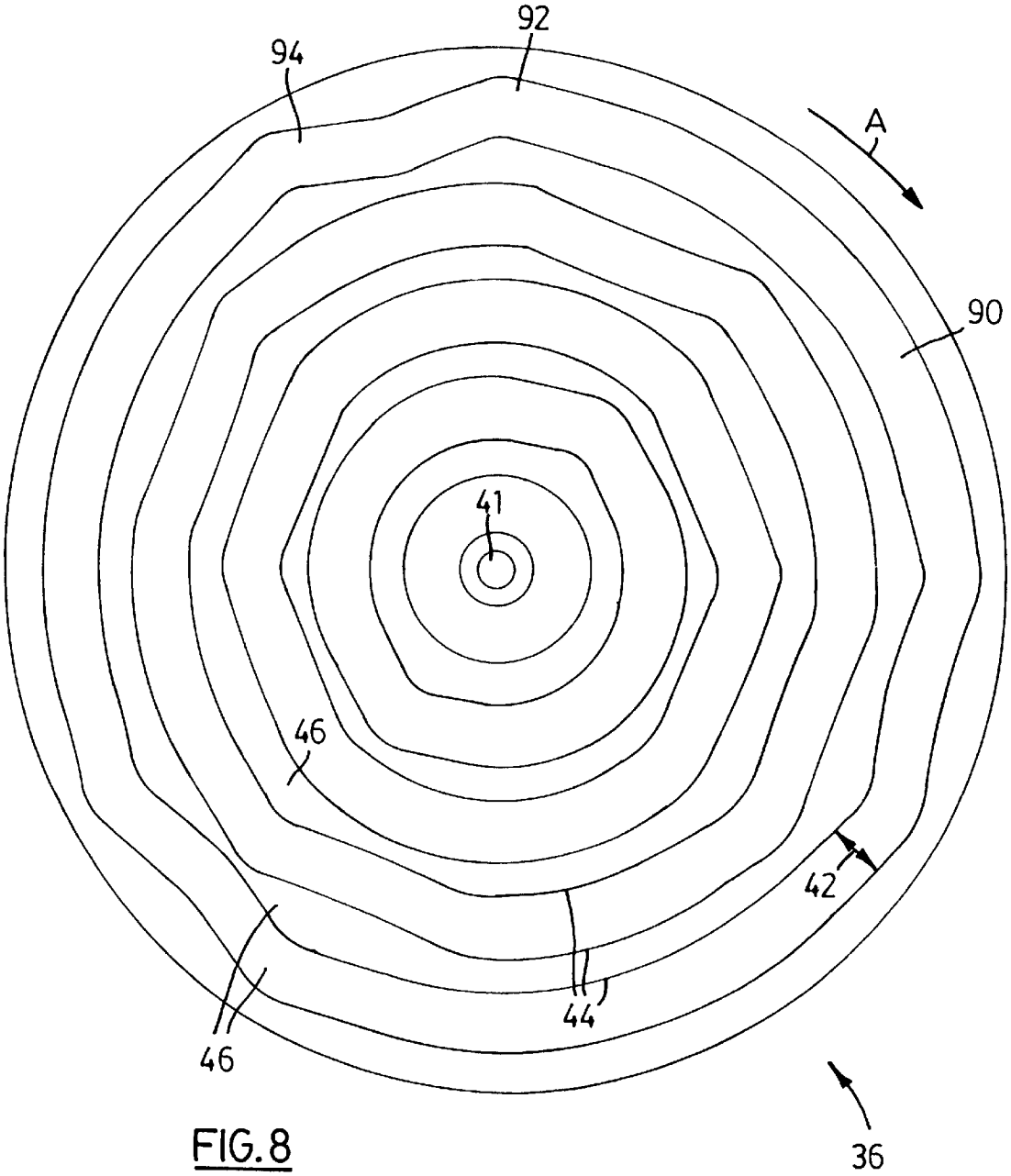
FIG. 8 is a top view of the finger platform.

In a particularly preferred embodiment, not only are the fingers moved upwardly and downwardly by the platform, but they are also pivoted about their respective transverse axes periodically by the platform. This pivoting motion is caused by the fact that the generally annular channels are irregular in their annular shape when viewed from above or in a direction perpendicular to the upper surface of the cover. This irregular shape is illustrated in FIG. 8. Because the cam tracks have side walls 44 that engage the bottom ends of the fingers, this irregular annular shape will periodically cause the upper end of each finger to pivot either radially outwardly from a central position or radially inwardly about the transverse pivot axis. The amount of this pivoting movement is limited since the extent is dependent upon the extent to which the cam track varies from its average radius measured from the central shaft 39. As can be seen from FIG. 8, although the side walls of each track extend generally parallel to each other, they slope or bend left or right at intervals relative to the direction of movement of the support member. For example, assuming that the platform is rotating clockwise in the direction indicated by the arrow A in FIG. 8, a finger 8 tracking along the outer cam track indicated at 90 would encounter a track section at 92 where the track slopes to the left. It would then encounter a track section at 94 which slopes to the right. The section 92 of the track would cause the upper end of the finger to pivot radially outwardly while the section 94 would cause the upper end of the finger to pivot radially inwardly.

Figure 7:
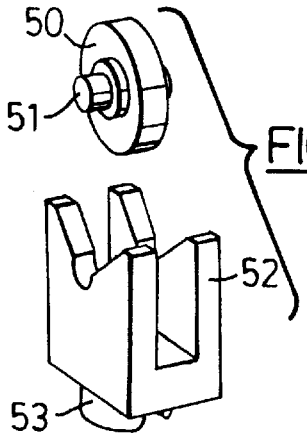
FIG. 7 is a perspective view of one wheel for supporting the finger platform and its supporting bracket.

The support for the platform 36 is shown clearly in FIG. 1. In addition to the central shaft 39 which provides some support, the platform is supported by four wheels 50 mounted on the base 4 and spaced at 90 degree intervals thereon. Each wheel 50 is supported by a pin member 51 about which the wheel turns. The wheel pin 51 is in turn supported by a U-shaped supporting bracket 52, the construction of which can be seen clearly from FIG. 7. The upright arms of this bracket support the pin 51 at its opposite ends. The bracket can be attached by adhesive located between the connecting base 53 of the bracket and the base 4. In the alternative and as illustrated, the bracket can be formed with one or two short connecting members 53 that project down from its bottom. The member or members 53 are sized to fit in a suitable hole 100 formed in the base 4. It will also be noted that the base 4 is formed with a central collar 40 to hold the bottom end of the shaft 39. A similar collar 41 is formed at the centre of the cover 2 to hold in place the top of this shaft. Although almost all of the components and parts of the massaging device 1 are made from a suitable, strong, rigid plastics material, the central shaft 39 can be made of a strong metal such as steel, if desired, for increased strength and rigidity. It is also possible to make this shaft of a strong, rigid plastic, if desired.

Figure 10:
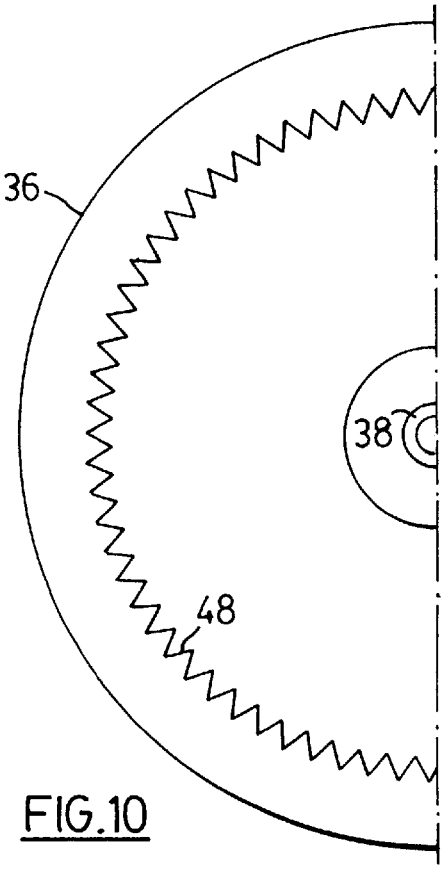
FIG. 10 is a bottom view showing one half of the finger platform, the other half being essentially the same.

As noted already, there is a power drive system, preferably one employing water power, for rotating the platform 36. In the preferred embodiment, this drive system includes the pinion gear 12 connected to the water wheel and a larger driven gear 48 engaged by the pinion gear and formed on the underside of the finger platform. The gear 48 can be seen clearly from FIG. 10. This gear comprises a continuous series of teeth extending about the inner circumference of the platform and sized to fit the teeth of the gear 12.

It will be appreciated that instead of the water drive illustrated, the finger platform could also be connected to an electrical drive unit in order to rotate same. In an electrical version, the movement of the finger platform and the actuation of the massaging fingers can be the same as in the illustrated embodiment. The electrical drive unit would employ a small electrical motor and could also include a gear mechanism to connect the shaft of this motor to the finger platform.

As illustrated in FIGS. 2 and 3, the holes 6 are preferably arranged in a series of concentric rings of varying diameter about the surface of the cover. Although five concentric rings of holes are illustrated, clearly the cover could be made with fewer or more rings, if desired.

It will be appreciated by those skilled in the art that various modifications and changes to the massaging device can be made without departing from the spirit and scope of this invention. Accordingly, all such modifications and changes as fall within the scope of the accompanying claims are intended to be part of this invention.

We therefore claim:

1. A massaging device suitable for massaging feet comprising:

a housing having a top cover with a plurality of holes distributed about its surface and extending through the cover, said housing also having an elongate water channel and a substantially enclosed water chamber formed therein, said channel extending to and opening into said water chamber;

a water wheel rotatably mounted in said water chamber and adapted to be rotated by water flowing through said channel and into and out of said chamber;

a plurality of massaging fingers mounted in said holes, each finger having a central longitudinal axis along which the finger is capable of moving to a limited extent;

a finger platform located in and rotatably mounted in said housing and supporting said plurality of fingers at their inner lower ends, said platform having a top surface provided with at least one camming surface for engaging the inner lower ends of said fingers; and a gear drive system operatively connecting said water wheel to said finger platform whereby rotation of said water wheel causes said finger platform to rotate, wherein rotation of said finger platform causes said at least one camming surface to push said fingers outwardly in a periodic manner in order to produce a massaging action by the fingers.

2. A massaging device according to claim 1 wherein said finger platform is dome shaped and is formed with a number of concentric, generally annular channels in an upper side thereof, each of said annular channels forming a camming surface for engaging the inner ends of some of said fingers.

3. A massaging device according to claim 2 wherein the camming surfaces formed by said channels are generally sinusoidal in shape when viewed along a vertical cross-section taken along the longitudinal centerline of each channel and which are irregular in their annular shape when viewed in a direction perpendicular to the upper surface of the cover.

4. A massaging device according to claim 2 including a threaded water inlet at one end of said elongate water channel adapted for connection to a water supply and a water outlet at another end of said elongate water channel opposite said one end thereof.

5. A massaging device according to claim 1 wherein each finger is provided with two pivot pins projecting from opposite sides of the respective finger and axially aligned with each other and vertical guide slots are formed in said cover adjacent each hole, said pivot pins being movable up and down in said slots, whereby each finger is pivotable to a limited extent about a transverse pivot axis defined by its pivot pins.

6. A massaging device according to claim 1 including pivot pins on said fingers for retaining said fingers in their respective holes and for permitting pivotal movement of their respective fingers about transverse axes defined by said pins.

7. A massaging device suitable for massaging feet comprising:

a housing having a cover with a plurality of holes distributed about its surface and extending through the cover and vertically extending guide slots formed therein at each hole;

a plurality of massaging fingers mounted in said holes, each finger having a central longitudinal axis along which the finger is capable of moving to a limited extent and having two pivot pins projecting from opposite sides thereof and axially aligned with each other, said pivot pins being movable up and down in their respective slots and being guided thereby;

a rotatable finger platform located in said housing and supporting said plurality of fingers at their inner ends, said platform being provided with at least two generally annular camming surfaces for engaging the inner ends of said fingers; and a power drive system provided in said housing for rotating said finger platform, whereby rotation of said finger platform causes said camming surfaces to push said fingers outwardly in a periodic manner in order to produce a massaging action by the fingers.

8. A massaging device according to claim 7 wherein said power drive system is operable by means of flowing water and includes a water wheel rotatably mounted in said housing.

9. A massaging device according to claim 8 wherein said power drive system includes a pinion gear connected to said water wheel and a larger driven gear engaged by said pinion gear and provided on said finger platform.

10. A massaging device according to claim 9 wherein said power drive system includes a sealed water channel and water wheel chamber formed in said housing, said water wheel being rotatably mounted in said chamber and said water channel bringing water into and out of said chamber during use of said device, said water channel having means for connecting a source of water to an inlet end of said channel.

11. A massaging device according to claim 7 wherein each finger is pivotable to a limited extent about a transverse pivot axis defined by its pivot pins, said pivoting being caused by each finger's respective camming surface which has an irregular annular shape when viewed from above said finger platform.

12. A massaging device according to claim 7 wherein said cover and finger platform are generally dome shaped and are coaxial along a central vertical axis, and wherein said annular camming surfaces are arranged at different heights relative to said vertical axis.

13. A massaging device comprising:

a housing having a cover with a number of holes in its surface that extend through the cover;

massaging fingers mounted in said holes with each finger having a central longitudinal axis along which the finger is capable of moving to a limited extent, pin members extending outwardly from said fingers in a transverse direction, said pin members defining a transverse pivot axis for each finger;

vertical guide slots for said pin members formed in said cover adjacent said holes, said pin members being movable up and down in their respective guide slots;

a movable support member located in said housing and supporting said fingers at their inner ends, said support member having an upper surface and being provided with at least one cam track for engaging the inner ends of said fingers extending along said upper surface, each cam track having a bottom and two sidewalls disposed on opposite sides of said bottom, the bottom of each cam track sloping or bending upwardly and downwardly at intervals along the length of the track and said sidewalls of each track extending generally parallel to each other and sloping or bending left or right at intervals relative to the direction of movement of said support member; and power drive system for moving said support member relative to said housing, whereby movement of said support member causes said at least one cam track to push said fingers upwardly in a periodic action and to pivot said fingers about their respective transverse pivot axes in order to produce a massaging action by the fingers.

14. A massaging device according to claim 13 wherein said support member rotates about a central vertical axis and is provided with a number of cam tracks for engaging the inner ends of said fingers.

15. A massaging device according to claim 13 wherein said power drive system is operable by means of flowing water and includes a water wheel rotatably mounted in said housing and said support member is a circular platform rotatable about a central vertical axis by said water wheel.

16. A massaging device according to claim 15 wherein said power drive system includes a pinion gear connected to said water wheel and a larger driven gear engaged by said pinion gear and formed on said platform.

17. A massaging device according to claim 13 wherein two of said pin members extend outwardly from opposite sides of each finger at a point near the longitudinal center of the finger.

18. A massaging device according to claim 17 wherein the inner end of each finger is rounded to form a hemisphere and said at least one cam track has a shape in transverse cross-section which is generally semi-circular.

19. A massaging device according to claim 17 wherein said power drive system is operable by means of flowing water and includes a water wheel rotatably mounted in said housing and said support member is a circular platform rotatable about a central vertical axis by said water wheel.

* * * * *